US005089829A

United States Patent [19]

Haruyama et al.

[11] Patent Number: 5,089,829

[45] Date of Patent: Feb. 18, 1992

[54] ANTENNA DEVICE SHARED BY THREE KINDS OF WAVES

[75] Inventors: Shinichi Haruyama, Takasaki; Hideaki Asai, Tokyo, both of Japan

[73] Assignee: Yokowo Mfg. Co., Ltd, Tokyo, Japan

[21] Appl. No.: 561,344

[22] Filed: Aug. 1, 1990

[30] Foreign Application Priority Data

Dec. 22, 1989 [JP] Japan ..... 1-333646
Dec. 22, 1989 [JP] Japan ..... 1-333647
Feb. 7, 1990 [JP] Japan ..... 2-11423[U]

[51] Int. Cl.[5] ..... H01Q 1/32

[52] U.S. Cl. ..... 343/852; 343/790; 343/792; 343/858; 343/903

[58] Field of Search ..... 343/745, 901, 715, 713, 343/790, 714, 749, 750, 852, 853, 858, 860, 822, 792, 903

[56] References Cited

U.S. PATENT DOCUMENTS

| | | | |
|---|---|---|---|
| 3,541,554 | 11/1970 | Shirey | 343/745 |
| 3,725,942 | 4/1973 | Ukmar | 343/715 |
| 3,973,202 | 8/1976 | Gardner | 343/715 |
| 4,095,229 | 6/1978 | Elliott | 343/715 |
| 4,141,016 | 2/1979 | Nelson | 343/715 |
| 4,721,965 | 1/1988 | Elliott | 343/715 |
| 4,734,703 | 3/1988 | Nakase et al. | 343/715 |
| 4,847,629 | 7/1989 | Shimazaki | 343/901 |
| 4,850,034 | 7/1989 | Campbell | 343/715 |

*Primary Examiner*—Michael C. Wimer

*Assistant Examiner*—Hoanganh Le

*Attorney, Agent, or Firm*—Koppel & Jacobs

[57] ABSTRACT

An antenna device shared by three different waves has a single two-stage collinear antenna constituted by half-wave dipole antennas which are adapted for a vehicle telephone signal and are stacked one upon the other. The device allows an AM-FM radio receiver to receive AM and FM broadcast signals via a first coaxial cable and a vehicle telephone transceiver to receive a telephone signal via a second coaxial cable. A first impedance converting circuit is implemented as a field effect transistor and connected to the base end of the antenna for matching the antenna and the first coaxial cable in the event of reception of the AM broadcast signal. A second impedance converting circuit matches the antenna and the first coaxial cable at the time of reception of the FM broadcast signal. The impedance converting circuits convert the input/output impedances of the AM and FM signals. The antenna has an antenna rod extending from the base end thereof, a feed tube electrically connected to the antenna rod, and an adjusting feed tube electrically connected to the feed tube and slidably mounted at one end thereof to one the terminating end of the feed tube, and formed with a feed point at the other end. The adjusting feed tube is adjustable in position in its sliding direction to adjust the input/output impedance of the telephone signal as measured at the feed point.

6 Claims, 9 Drawing Sheets

ANTENNA DEVICE SHARED BY THREE KINDS OF WAVES

BACKGROUND OF THE INVENTION

The present invention relates to an antenna device having a single antenna which bifunctions as an antenna of a radio receiver for AM and FM bands and an antenna of a mobile telephone transceiver. More particularly, the present invention is concerned with an antenna device having a collinear array antenna in the form of half-wave dipole antennas which are adapted for a mobile telephone receiver and are stacked in two stages. This kind of antenna device is applicable to an AM-FM radio receiver and a mobile telephone transceiver both of which are mounted on a vehicle, allowing the receiver to efficiently receive AM and FM broadcasts and allowing the transceiver to transmit and receive a mobile telephone signal.

It has been customary to provide a vehicle-mounted AM-FM radio receiver with an about 1.0 to 1.4 meter long rod antenna which is telescopically mounted on, for example, the roof of a vehicle. A 75 or 50 ohm coaxial cable is connected to the base end of the rod antenna. AM and FM broadcast signals are delivered by the coaxial cable to the AM-FM radio receiver which is mounted on the console inside of the vehicle independently of the antenna. A vehicle-mounted or car telephone which is extensively used today has a two-stage collinear array antenna. This kind of antenna is constituted by stacking half-wave dipole antennas adapted for a mobile telephone signal one above the other and is mounted on, for example, the hood of a vehicle. A 75 or 50 ohm coaxial cable connects the base end of the collinear array antenna to a telephone transceiver which is located in the vehicle cabin, allowing the tranceiver to transmit and receive a telephone signal.

As stated above, a vehicle loaded with an AM-FM radio receiver and a telephone transceiver customarily has both of a rod antenna and a two-stage collinear array antenna. Mounting a plurality of antennas on a vehicle is undesirable because they mar the appearance of an otherwise fine exterior design of the vehicle and because they aggravate the hissing sound while the vehicle is operated. Of course, the plurality of antennas protruding to the outside from the vehicle body are more dangerous than a single antenna. To reduce the number of antennas, the rod antenna for the AM-FM radio and which is about 1 meter long may be so constructed as to play the role of the antenna for the telephone transceiver also. It is to be noted that the length of about 1 meter of the rod antenna corresponds to substantially one-quarter wavelengh of the FM broadcast signal and is selected to achieve a high antenna gain for FM broadscasts by antenna resonance.

The antenna protruding from the vehicle body should be as short as possible as mentioned above in order to provide the vehicle with attractive appearance, to reduce hissing sound, and to prevent the antenna from hitting against or contacting a garage, structures on the road, etc. Another approach is, therefore, to use the two-stage colliear array antenna for the telephone transceiver as the antenna of the AM-FM radio receiver also. However, this antenna is only 40 centimeters long or so and cannot cause the FM broadcast signal to resonate, failing to function as an FM antenna due to the critically low gain. Such an antenna is not desirable for receiving AM broadcasts either, because the shorter the length, the lower the signal strength which can be received is. It is impractical, therefore, to allow the collinear array antenna having the convenional structure to be shared by the telephone transceiver and the AM-FM receiver.

The two-stage collinear array antenna and the coaxial cable have to be matched so that the telephone signal coming in through the antenna may be efficiently delivered to the telephone transceiver and the telephone signal may be efficiently radiated from the antenna. For this purpose, there has been proposed a feed structure in which the base end of the collinear array antenna is extended to the inside of the vehicle and, at a position where the antenna can be matched to the coaxial cable, electrically connected to the coaxial cable. However, when the carrier frequency is as high as 870 to 940 MHz as with the telephone signal, the wavelength is correspondingly short. Hence, when the position where the antenna is electrically connected to the coaxial cable is deviated even slightly, the deviation is critical when it comes to the wavelength and prevents desired matching from being achieved. It is desirable, therefore, that the position of the feed point be adjustable at the production stage.

U.S. Pat. No. 4,847,629 discloses an arrangement wherein the role of the antenna for AM-FM radio reception and that of the antenna for mobile telephone reception are played by a single antenna. With this arrangement, it is also possible to adjust the position of the feed point defined at the base end of the single antenna for thereby adjusting the input/output impedance. The drawback with such an implementation, however, is that a stub or a balun having a length approximately that of one-quarter wavelength protrudes noticeably into the vehicle cabin from the feed point. Moreover, no consideration is given to the decrease in the strength of the received FM broadcast signal which is ascribable to the short antenna.

SUMMARY OF THE INVENTION

It is therefore an object of the present invention to provide a shared antenna device which is capable of receiving AM and FM broadcast signals satisfactorily and transmitting and receiving a mobile telephone signal, by using a single two-stage collinear array antenna which is comparatively short and constituted by a stack of half-wave dipole antennas adapted for the telephone signal.

It is another object of the present invention to provide a shared antenna device which uses a field effect transistor for converting the output impedance of an AM broadcast signal received by a single short, two-stage collinear array antenna.

It is another object of the present invention to provide an antenna device shared by three different waves and which allows the input/output impedance of a mobile telephone signal transmitted and received by a two-stage collinear array antenna to be adjusted and does not noticeably protrude into a vehicle cabin.

An antenna device for allowing an AM-FM radio receiver to receive AM and FM broadcast signals and allowing a vehicle telephone transceiver to transmit and receive a telephone signal of the present invention comprises a single two-stage collinear array antenna comprising half-wave dipole antennas which are adapted for the telephone signal and stacked in two stages, a first coaxial cable for applying the AM and FM broadcast signals received by the antenna to the AM-FM radio receiver, a second coaxial cable for applying the telephone signal received by the antenna to the telephone transceiver and the telephone signal outputted by the telephone transceiver to the antenna, a first matching circuit connected between the base end of the antenna and the first coaxial cable for matching the antenna and the first coaxial cable when the AM broadcast signal is received, and a second matching circuit for matching the antenna and the first coaxial cable when the FM broadcast signal is received. The first and second matching circuits feed output signals thereof to the AM-FM radio receiver via the first coaxial cable.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
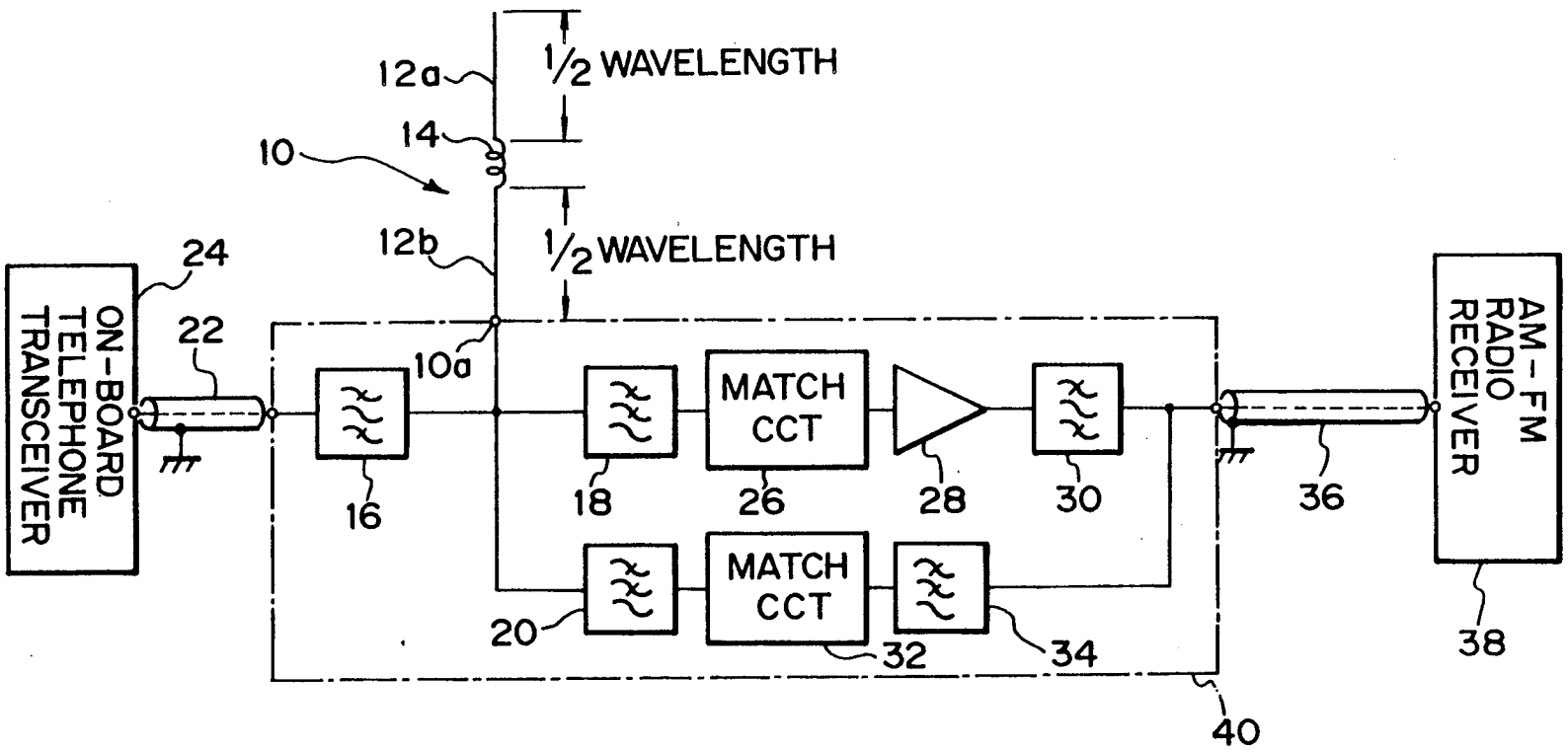
FIG. 1 is a block diagram schematically showing a shared antenna device embodying the present invention.

Referring to FIG. 1 of the drawings, an antenna device embodying the present invention is shown and includes a two-stage collinear array antenna 10. The antenna 10 has dipole antennas 12*a* and 12*b* which are stacked one above the other with the intermediary of a phasing coil 14. The dipole antennas 12*a* and 12*b* each has a length approximately that of one-half wavelength of a vehicle telephone (870 to 940 MHz). Connected to the base end 10*a* of the collinear array antenna 10 are a bandpass filter 16 which passes the telephone signal, a low pass or bandpass filter 18 which passes a FM broadcast signal (76 to 90 MHz), and a low pass or bandpass filter 20 which passes an AM broadcast signal (525 to 1605 kHz). These filters 16, 18 and 20 separate signals belonging to the individual frequency bands. A vehicle telephone signal passed the filter 16 is applied to a telephone transceiver 24 via a coaxial cable or similar cable 22 whose impedance is 50 ohm, for example. A FM broadcast signal passed the filter 18 is routed through a matching circuit 26 to a low noise amplifier 28 and amplified thereby. The output of the amplifier 28 is fed to a bandpass filter 30 which then passes only the FM signal again. Further, an AM broadcast signal passed the filter 20 is delivered to a low pass filter 34 via a matching circuit 32. The FM and AM signals passed the bandpass filter 30 and low pass filter 34, respectively, are again superposed and then applied to an AM-FM radio receiver 38 by a coaxial cable 36 whose impedance is 50 ohms, for example. The filters 16, 18, 20, 30 and 34, matching circuits 26 and 32, and low noise amplifier 28 are accommodated in a single metallic casing 40, and the casing 40 is fixed in place at the base end of the antenna 10.

Figure 2:
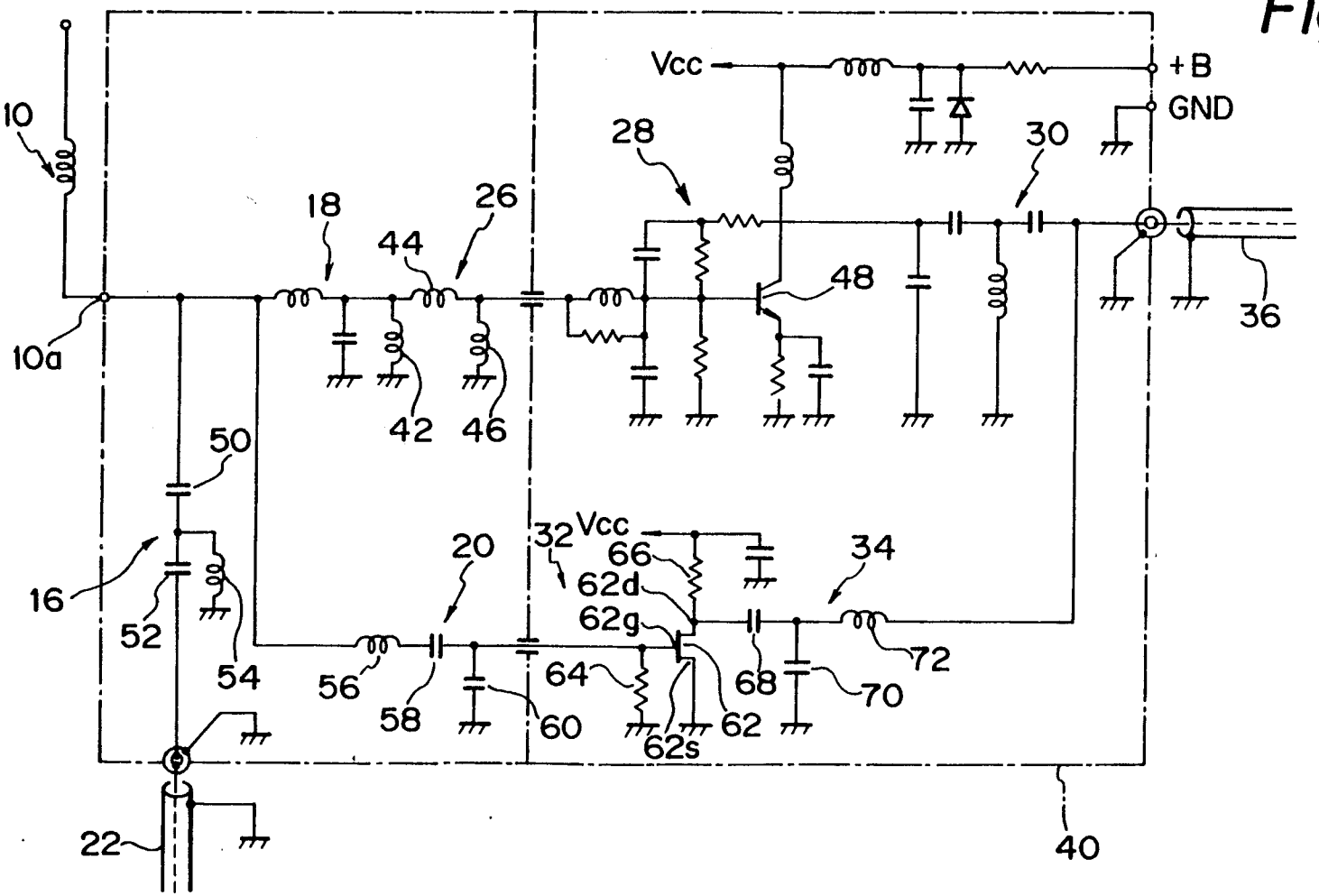
FIG. 2 is a circuit diagram showing a specific construction of the illustrative embodiment.

FIG. 2 shows the antenna device of FIG. 1 specifically. In FIG. 2, circuit sections constituting the various blocks of FIG. 1 are designated by the same reference numerals. As shown, the base end 10*a* of the collinear array antenna 10 is connected to the matching circuit 26 via the filter 18. The matching circuit 26 has coils 42, 44 and 46 which are connected in a generally $\pi$ configuration, constituting an impedance converting circuit. The output of the matching circuit or impedance converting circuit 26, i.e., a signal with a converted impedance is fed to the low noise amplifier 28 which has a transistor 48 as an amplifying element. The amplified output of the amplifier 28 is applied to the bandpass filter 30 with the result that only the amplified FM broadcast signal is passed and fed to the coaxial cable 36. The base end 10*a* of the antenna 10 is also connected to the coaxial cable 22 via the bandpass filter 16 which is implemented as a T connection of capacitors 50 and 52 and a coil 54. Further, the base end 10*a* is connected to the gate 62*g* of an n-channel MOS FET 62 via the low pass filter 20. The low pass filter 20 has a series connection of a coil 56 and a capacitor 58 and a capacitor 60 which are connected in an L configuration. The gate 62*g* of the FET 62 is connected to ground via a resistor 64, the drain 62*d* is connected to a power source Vcc via a resistor 66, and the source 62*s* is connected directly to ground. The matching circuit 32 including the FET 62 also constitutes an impedance converting circuit. The drain 62*d* of the FET 62 is further connected to the coaxial cable 36 via the low pass filter 34 which comprises a T connection of capacitors 68 and 70 and a coil 72. These circuits extending from the base end 10*a* of the antenna 10 to the coaxial cables 22 and 36 are incorporated in the previously mentioned casing 40.

The collinear array antenna 10 is too short to cause an AM broadcast signal to resonate, so that the output impedance of such a signal at the base end or feed point of the antenna 10 is substanially infinite. Even if the 75 or 50 ohm coaxial cable 36, for example, is connected to the base end 10*a*, most of AM broadcast signals are reflected due to mismatching and not transmitted to the radio receiver. In the illustrative embodiment, therefore, an AM signal coming in through the antenna 10 is fed to the gate 62*g* of the FET 62 whose input impedance is extremely high, and the resultant amplified output is converted to an adequate output impedance and then applied to the coaxial cable 36. This is successful in matching the antenna 10 and coaxial cable 36 and, therefore, in transmitting AM signals efficiently over the cable 36 with a minimum of reflection.

Concerning FM broadcast signals, the output impedance of the antenna 10 greatly differs from the input impedance of the coaxial cable 36 although it is not infinite. Moreover, the antenna 10 is too short to cause a FM signal to resonate, so that the received signal is weak. In the illustrative embodiment, the matching circuit or impedance converting circuit 26 adapted for FM broadcasts is connected to the base end 10*a* of the antenna 10. Such a configuration matches the antenna 10 and coaxial cable 36 and thereby transmits received FM signals more efficiently to the radio receiver.

The performance of the illustrative embodiment will be described hereinafter. Since the illustrative embodiment uses the two-stage collinear array antenna 10 designed for a vehicle telephone transreceiver, it of course has the same capability as prior art devices as to the telephone signal. The illustrative embodiment, therefore, will have significance only if it achieves performance equivalent or superior to that of the prior art device using a rod antenna which is about 1 meter long. We conducted auditory tests and measured carrier-to-noise (C/N) ratios in order to determine the performance of the illustrative embodiment, as will be described hereinafter.

Figure 3A:
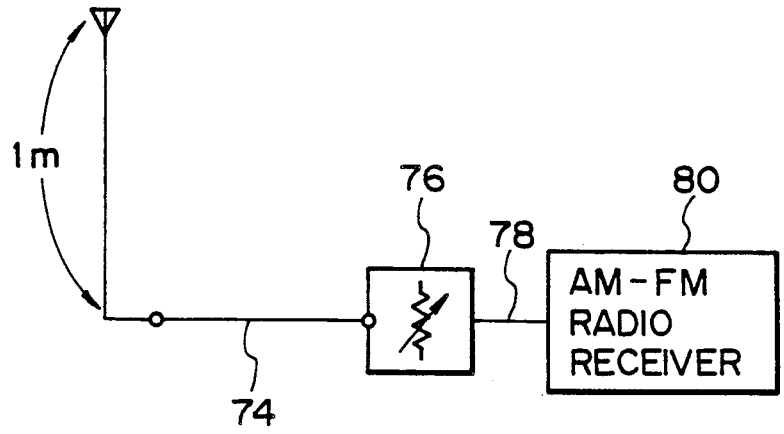
Fig.3A PRIOR ART
FIGS. 3A to 3C are block diagrams representative of specific arrangements for comparing the performance of the illustrative embodiment with the prior art by auditory tests.
Figure 3B:
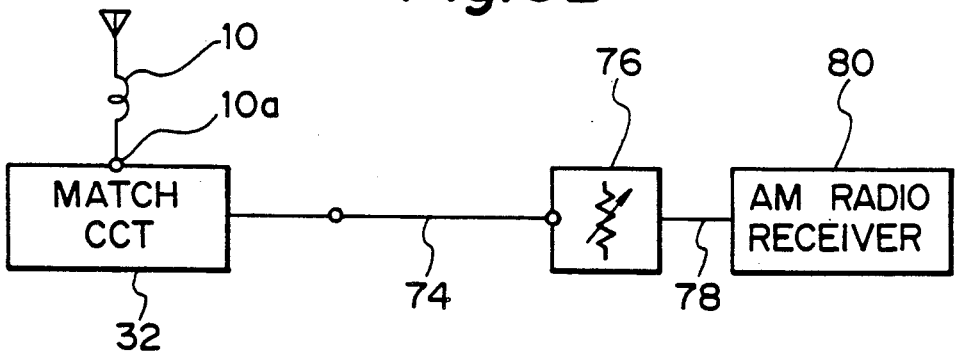
Figure 3C:
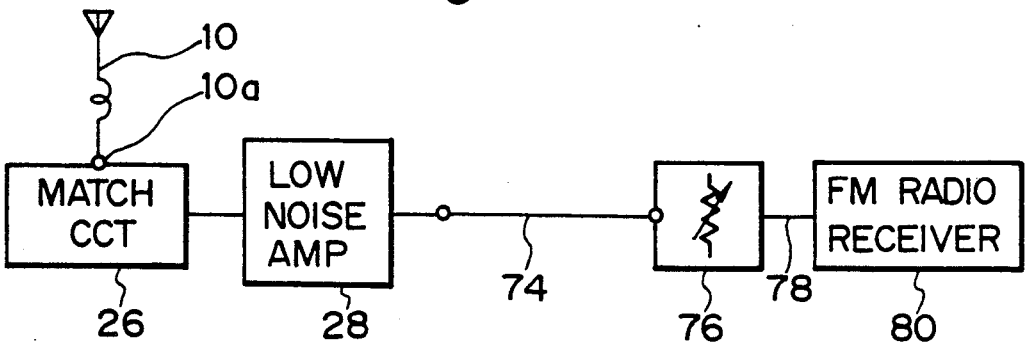

For the auditory tests, as shown in FIG. 3A, use is made of a prior art device for comparison which has an about 1 meter long rod antenna whose base end is connected to an attenuator 76 by a 50 ohm, approximately 5 meter long coaxial cable 74. The attenuator 76 is connected to an AM-FM radio receiver 80 by a 50 ohm, 1 meter long coaxial cable 78. For AM broadcasts, as shown in FIG. 3B, the illustrative embodiment has the matching circuit or impedance converting circuit 32 connected to the base end 10*a* of the collinear array antenna 10, and the output terminal of the circuit 32 is connected to the attenuator 76 by the coaxial cable 74. The rest of the construction is the same as that of FIG. 3A. For FM broadcasts, as shown in FIG. 3C, the illustrative embodiment has the matching circuit or impedance converting circuit 26 connected to the base end 10*a* of the antenna 10, the low noise amplifier 28 is connected serially to the output terminal of the circuit 26, and the output terminal of the amplifier 28 is connected to the coaxial cable 74. The rest of the construction is the same as that of FIG. 3A. Of course, the AM-FM radio receiver 80 shown in FIG. 3A is comparable in performance with the AM raidio receiver 80 and FM radio receiver 80 shown in FIGS. 3B and 3C, respectively, regarding the comparison as to AM and FM broadcasts.

Auditory tests were conducted by setting the maximum volume available with the AM-FM radio receiver 80, sequentially attenuating the signal by the attenuator 76, and measuring the amount of attenuation when voice coming out of the receiver 80 became hard to catch. The receiver 80 was tuned to specific AM broadcast frequencies of 594 kHz, 810 kHz, 954 kHz, 1134 kHz and 1242 kHz available in Japan. While the amounts of attenuation measured with the prior art were 26 dB, 4 dB, 10 dB, 13 dB and 11 dB for the above-mentioned frequencies, the amounts of attenuation measured with the illustrative embodiment were 38 dB, 22 dB, 22 dB, 21 dB and 15 dB. Hence, for all the specific frequencies, the illustrative embodiment is greater in the amount of attenuation than the prior art, i.e., the former is capable of transmitting AM broadcast signals more efficiently to the AM-FM radio receiver 80 than the prior art. Further, the AM-FM radio receiver 80 was tuned to specific FM broadcast frequencies of 77.1 MHz, 80.0 MHz and 86.3 MHz also available in Japan. The amounts of attenuation measured by using such FM frequencies were 0 dB, 2 dB and 42 dB with the prior art and 7 dB, 15 dB and 52 dB with the illustrative embodiment. It will be seen, therefore, that the illustrative embodiment is capable of transmitting even FM broadcast signals more efficiently to the receiver 80 than the prior art.

Figure 4A:
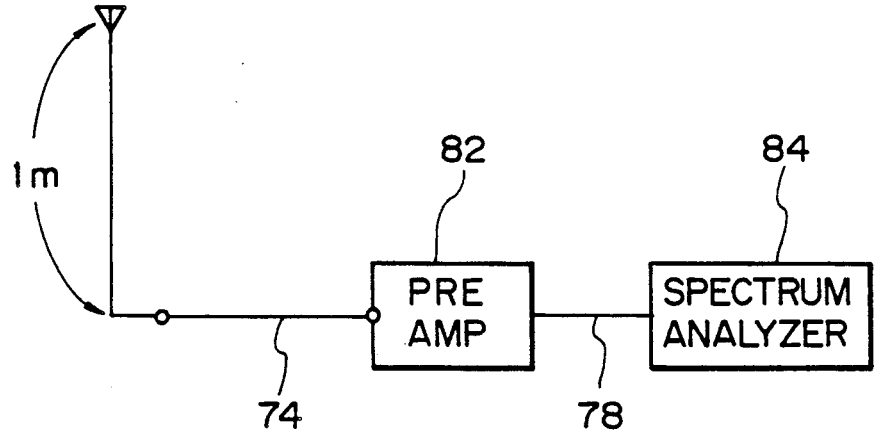
Fig. 4A PRIOR ART
FIGS. 4A to 4D are block diagrams indicating a method for the measurement of C/N ratios.
Figure 4B:
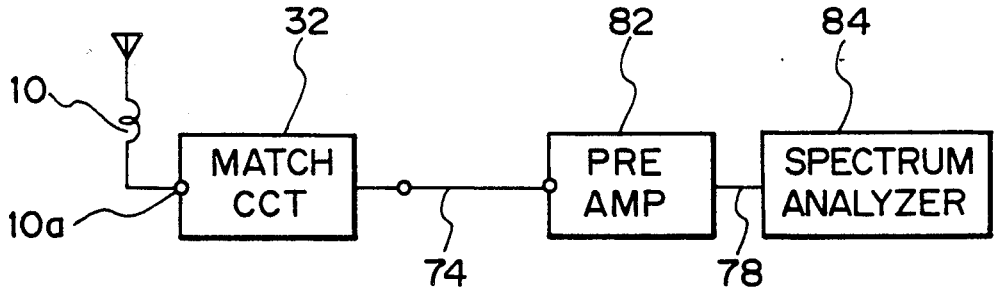

For the measurement of C/N ratios in the reception of AM broadcasts, a prior art device to be compared with the illustrative embodiment is constructed as shown in FIG. 4A. Specifically, the base end of an approximately 1 meter long rod antenna is connected to a preamplifier 82 having a gain of 30 dB by a 5 meters long coaxial cable 74. The output of the preamplifier 82 is connected to a spectrum analyzer 84 by a coaxial cable 78. On the other hand, as shown in FIG. 4B, the illustrative embodiment has the matching circuit or impedance converting circuit 32 connected to the base end 10*a* of the collinear array antenna 10. The output of the circuit 32 is connected to the preamplifier 82 by the coaxial cable 74. The rest of the construction is the same as with the prior art of FIG. 4A. Since the antenna noise is lower than the input noise of the spectrum analyzer 84, the preamplifer 82 is used to amplify the antenna noise so that the spectrum analyzer may read it.

With the prior art device of FIG. 4A, the spectrum analyzer 84 measured C/N ratios of 15 dB, 10 dB, 20 dB, 19 dB and 20 dB for the specific AM frequencies of 594 kHz, 810 kHz, 954 kHz, 1134 kHz, and 1242 kHz, respectively. In contrast, the C/N ratios which the spectrum analyzer 84 measured with the illustrative embodiment were 25 dB, 9 dB, 19 dB, 23 dB and 18 dB for the same AM frequencies as the prior art. The illustrative embodiment, therefore, achieves C/N ratios comparable with those of the prior art over the entire frequency band.

Figure 4C:
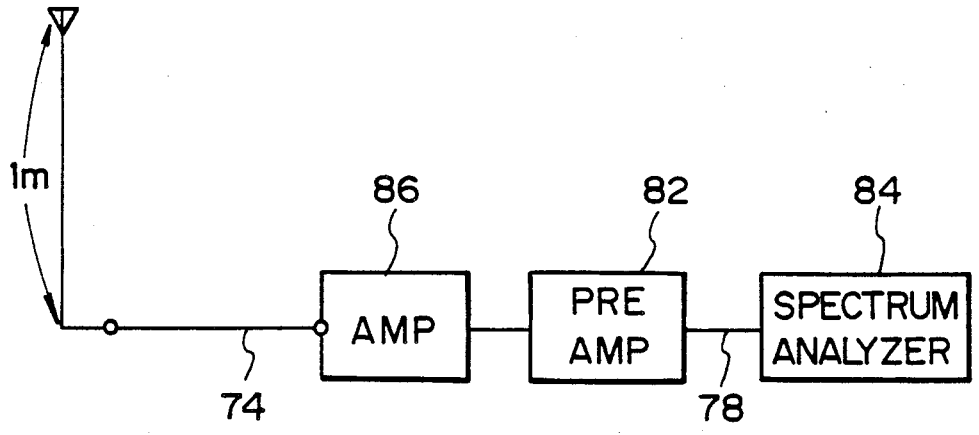
Fig.4C PRIOR ART
Figure 4D:
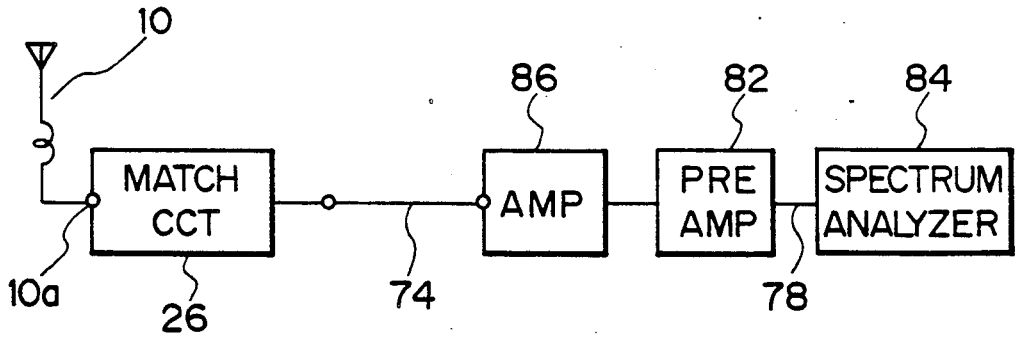
Figure 5:
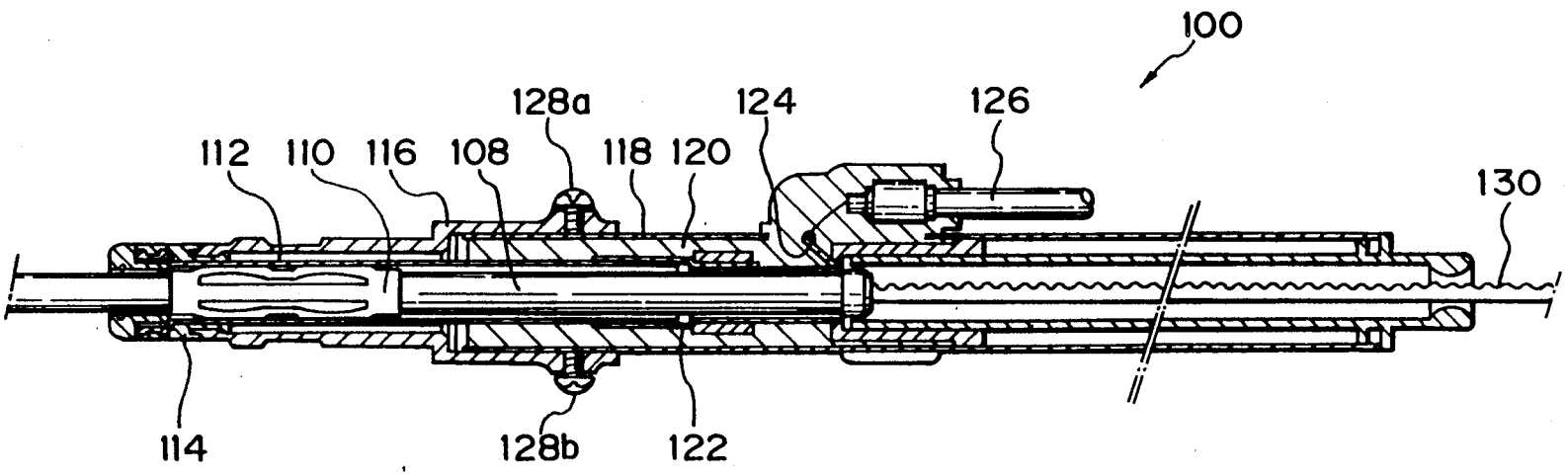
FIG. 5 is a vertical section showing a specific construction of a feed section included in the illustrative embodiment.
Figure 6:
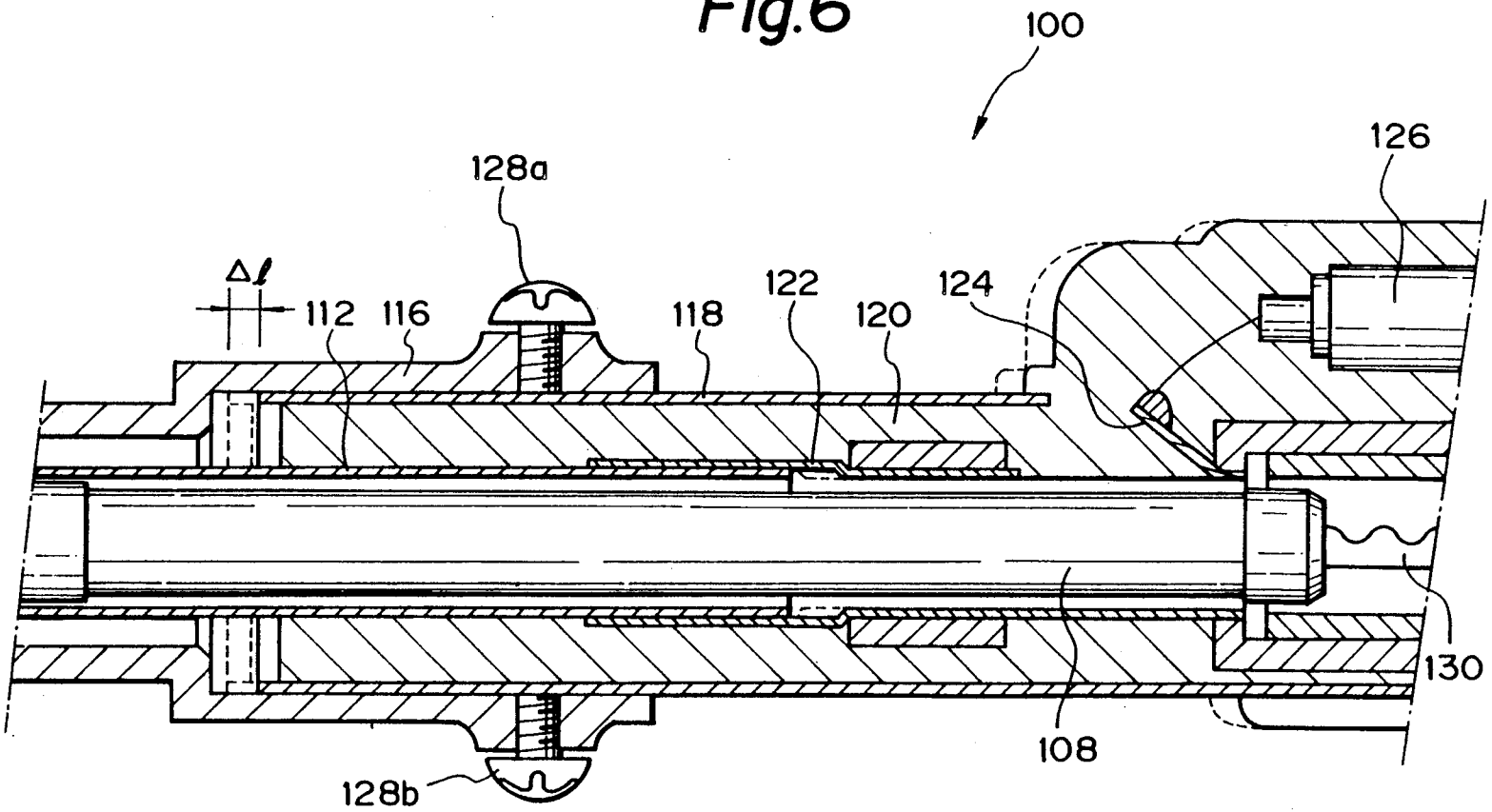
FIG. 6 is a fragmentary enlarged view of the feed section.

For the measurement of C/N ratios in the reception of FM broadcasting, a prior art device is constructed as shown in FIG. 4C for comparison purpose. As shown, the base end of an approximately 1 meter long rod antenna is connected to a first amplifier 86 by the coaxial cable 74 which is 5 meter long and has an impedance of 50 ohms. The output of the amplifier 86 is connected to the spectrum analyzer 84 by the 50 ohm, 1 meter long coaxial cable 78. As shown in FIG. 4D, the illustrative embodiment has the base end 10*a* of the collinear array antenna 10 connected to the matching circuit or impedance converting circuit 26. The output of the circuit 26 is connected to the first amplifier 86 by the coaxial cable 74. The rest of the construction is the same as the prior art shown in FIG. 4C.

With the prior art device of FIG. 4C, the spectrum analyzer 84 measured C/N ratios of 11 dB, 13 dB and 56 dB for the specific FM frequencies of 77.1 MHz, 80.0 MHz, and 86.3 MHz, respectively. The C/N ratio of the illustrative embodiment were measured to be 18 dB, 21 dB and 57 dB for the same FM frequencies as the prior art. The illustrative embodiment, therefore, constitutes an improvement over the prior art over the entire FM band.

As stated above, the illustrative embodiment receives AM and FM broadcast signals and receives and transmits a vehicle telephone signal with equivalent or even superior performance to the prior art by using a single antenna. Especially, when the base end 10*a* of the collinear array antenna 10 and the coaxial cable are matched by the matching circuit or impedance converting circuit 32 implemented by the FET 62 as shown in FIG. 2, the AM signal received by the antenna 10 is applied efficiently to the coaxial cable 36 and therefrom to the AM radioreceiver. The collinear antenna 10 is adapted for a vehicle telephone transceiver and approximately as short as 40 centimeters which is less than one-half the length of the conventional AM-FM radio antenna, i.e. approximately 1 meter. A vehicle with such a short shared antenna will have attractive appearance, reduce the hissing sound ascribable to the antenna, and little chance to have the antenna broken by a garage and structures on the road. While two exclusive antennas have heretofore been needed, one for the reception of AM and FM broadcasts and the other for the transmission and reception of a telephone signal, the illustrative embodiment needs only a single antenna and, therefore, reduces the cost of the entire device.

In the illustrative embodiment, the antenna shared by three different waves is constituted by the two-stage collinear antenna 10 having two half-wave dipole antennas adapted for a vehicle telephone signal and stacked one upon the other. Alternatively, the shared antenna may be implemented as a two-stage colliear array antenna having a half-wave dipole antenna adapted for a vehicle telephone signal and a quarter-wave dipole antenna which are stacked one above the other.

Hereinafter will be described a specific construction of a feed section included in the shared antenna device of the present invention. The shared antenna device is assumed to be a two-stage colliear array antenna having a half-wave dipole antenna for an AM-FM radio receiver, a phasing coil, and a quarter-wave dipole antenna which are stacked together. The feed structure which will be described allows the position of the feed point to be adjusted as needed.

Referring to FIGS. 5, 6 and 7A to 7C, a two-stage collinear array antenna 100 has a half-wave dipole antenna 102, a phasing coil 104, and a quarter-wave dipole antenna 106 which are stacked together. The quarter-wave, or lower, dipole antenna 106 has an antenna rod 108 which is extended by a length approximately five-twelfth wavelength into the vehicle body at the base end side of the antenna 106. A feed spring 110 is affixed to the extended part of the antenna rod 108 and serves as a conductive resilient member. The feed spring 110 has a sliding portion which is made of phosphor bronze, for example, and provided with a barrel-like shape. The antenna rod 108 is slidably received in a feed tube 112 made of a conductive material and has the sliding portion of the feed spring 110 held in slidable contact with the inner periphery of the tube 112. The feed tube 112 is formed integrally with a tubular base member 116 with the intermediary of an insulating material 114. Means for fixing the tubular base member 116 to the vehicle body is suitably provided on the leading end of the base member 116, although not shown in the figures. A tubular feed base member 118 is received in the trailing end of the base member 116. An insulating member 120 is positioned in the feed base member 118 and formed with a through bore for receiving the feed tube 112. A conductive feed tube 122 for adjustment is positioned inside of the through bore of the insulating member 120 and formed integrally with the wall of the through bore.

When the feed base member 118 is inserted into the tubular base member 116, the leading end of the adjusting feed tube 122 is slidably engaged with and electrically connected to the trailing end of the feed tube 112. The trailing end of the adjusting feed tube 122 is partly cut and raised to form a pawl 124 as a feed point. A coaxial cable 126 is connected to the pawl 124 and plays the role of a feed line. Setscrews **128*a* and 128*b* are held in threaded engagement with the tubular base member 116 for fixing the position of the adjusting feed tube 122 relative to the feed tube 112. The setscrews 128*a* and 128*b* may be loosened to adjust the position of the adjusting feed tube 122 relative to the feed tube 112 in the telescoping direction of the antenna rod 108. When the feed tube 112 and adjusting feed tube 122 are coupled together, the distance between the leading end of the tube 112 and the position of the tube 122 where the pawl 124 is located corresponds to approximately five-twelfth wavelength. The portion where the pawl 124 and coaxial cable 126 are electrically connected is entirely covered concealed by an insulating member 120. A drive cord 130 extends throughout the antenna rod 108** and is connected to the trailing end of the retractable upper antenna pole.

In the above construction, when the drive cord 130 is paid out by a motor, not shown, the upper antenna pole protrudes from the antenna rod 108 in the extending direction. Then, the antenna rod 108 is moved in the feed tube 112 toward the leading end until the feed spring 110 restricts its movement. Consequently, the collinear array antenna 100 is fully extended. When the drive cord 130 is reeled up, the upper antenna pole is retracted into the antenna rod 108. Subsequently, the antenna rod 108 is moved in the feed tube 112 in the retracting direction with the result that the antenna 100 is fully retracted into the vehicle body.

Figure 7A:
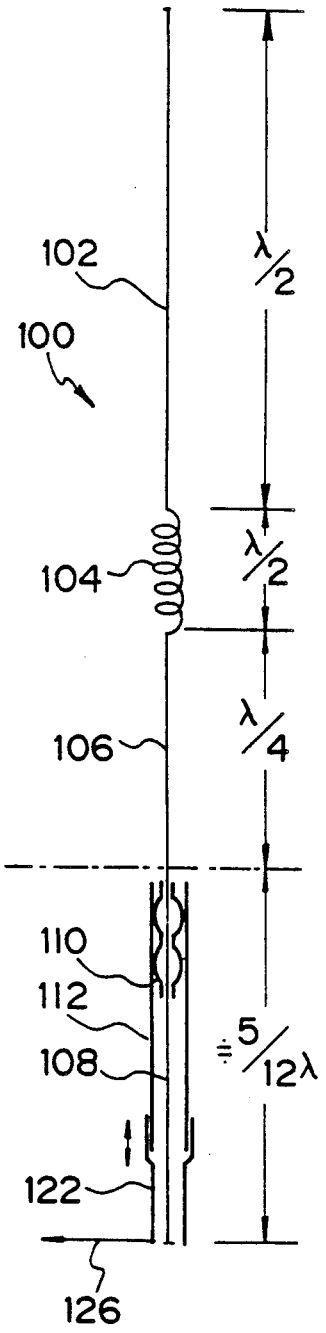
FIGS. 7A to 7C are views useful for understanding the electrical characteristics of the antenna device of FIG. 5 against a mobile telephone signal.
Figure 7B:
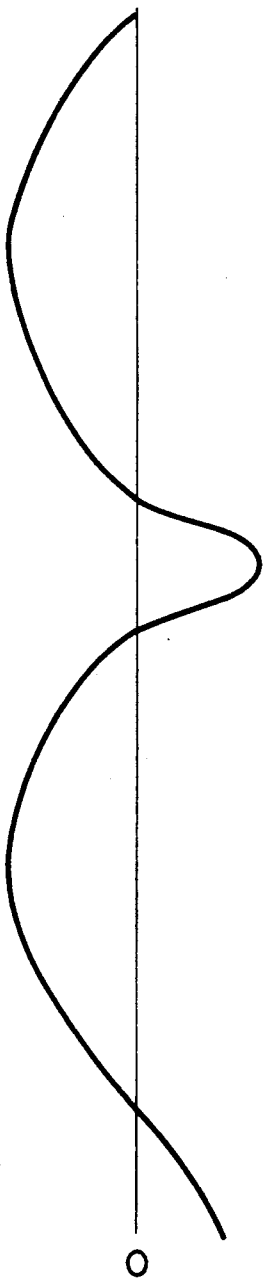
Figure 7C:
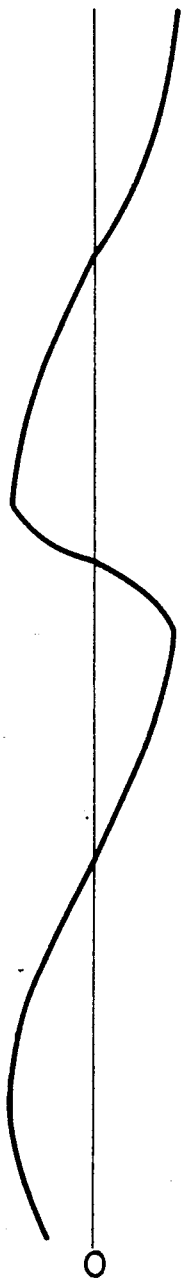

FIG. 7A schematically indicates the extended condition of the antenna 100. In this condition, current and voltage are distributed as shown in FIGS. 7B and 7C, respectively. When the feed point to which the coaxial cable 126 is connected is selected to correspond to approximately five-twelfths wavelength as measured from the vehicle body, the input/output impedance of the vehicle telephone signal as measured at the feed point is about 50 ohms. Hence, the setscrews **128*a* and 128*b* may be loosened to slide the feed base member 118 in its axial direction until the mating length of the adjusting feed tube 122 with the feed tube 112 has been suitably adjusted by $\Delta l$, FIG. 6. This is successful in setting up an input/output impedance optimal for the coaxial cable 126**.

Figure 8:
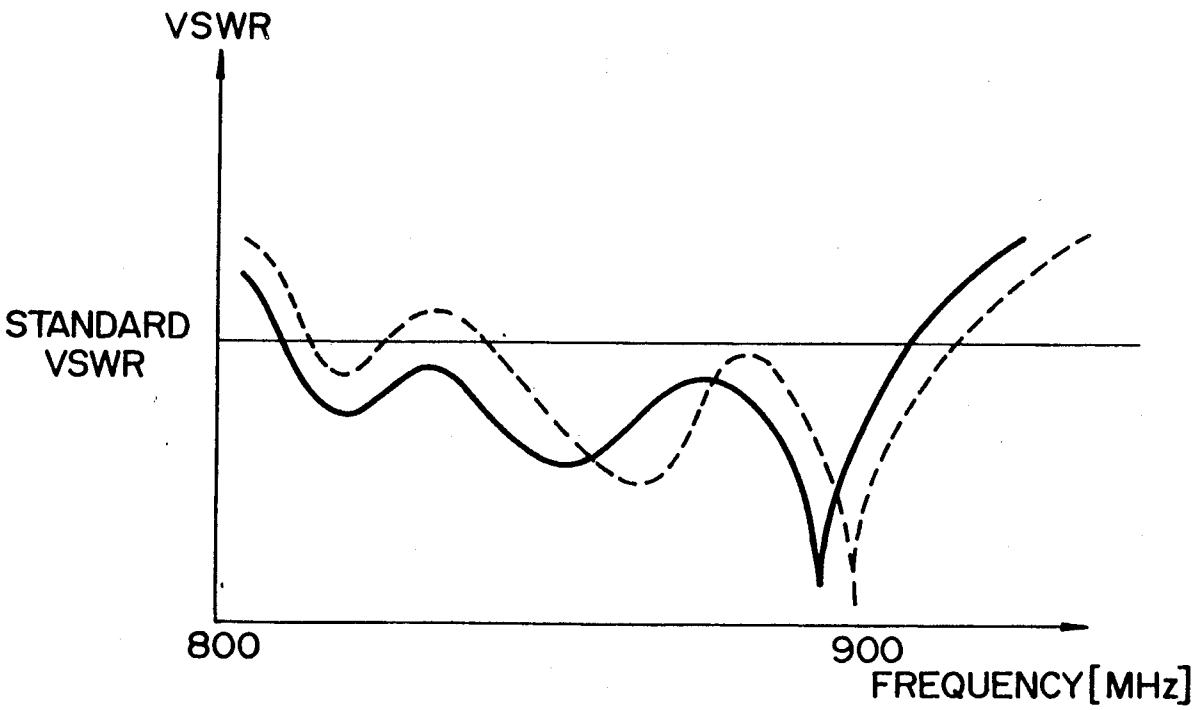
FIG. 8 is a graph showing a change in the standing-wave ratio characteristic of an antenna associated with the adjustment of the feed point.

FIG. 8 plots a change in the standing-wave ratio characteristic attainable by the above-stated adjustment. As shown, by adjusting the feed point, it is possible to selectively provide the collinear array antenna 100 with different standing-wave ratios as represented by a solid line and a phantom line in the figure.

As stated above, after the shared antenna device has been produced, the position of the adjusting feed tube 122 and, therefore, the feed point of the antenna can be adjusted to absorb irregularities in dimensions and other factors. This, coupled with the fact that the feed point is so located as to provide an optimal input/output impedance, surely matches the collinear array antenna 100 and coaxial cable 126. Especially, since a vehicle telephone signal has a high carrier frequency, the matching will be noticeably improved even by slight adjustment of the adjusting feed tube. There is no stub or balun otherwise extending from the feed point to which the coaxial cable is connected, whereby the antenna 100 is prevented from noticeably protruding into the vehicle body. When the antenna rod 108 is inserted into the feed tube 112 with the intermediary of the feed spring or elastic resilient member 110, the antenna rod 108 will movable telescopically in the feed tube 112 to implement a telescopic antenna.

Various modifications will become possible for those skilled in the art after receiving the teachings of the present disclosure without departing from the scope thereof. For example, the setscrews **128*a* and 128*b* used to fix the adjusting feed tube 122 may be replaced with any other suitable fastening means so long as it is capable of preventing the tube 122** from being dislocated after the adjustment of the feed point.

What is claimed is:

1. An antenna device for allowing an AM-FM radio receiver to receive AM and FM broadcast signals and allowing a vehicle telephone transceiver to transmit and receive a telephone signal, said antenna device comprising:

a single two-stage collinear array antenna comprising fractional-wave dipole antennas which are adapted for the telephone signal and stacked in two stages;

a first coaxial cable for applying the AM and FM broadcast signals received by said antenna to the AM-FM receiver;

a second coaxial cable connected between a base end of said antenna and the telephone transceiver for applying the telephone signal received by said antenna to the telephone transceiver and the telephone signal outputted by said telephone transceiver to said antenna, the impedance at said end of said antenna being substantially equal to the impedance of said second coaxial cable in response to the telephone signal;

first impedance matching circuit means connected between said base end of said antenna and said first coaxial cable for selectively matching the impedance at said base end of said antenna to the impedance of said first coaxial cable in response to the AM broadcast signal; and second impedance matching circuit means connected between said base end of said antenna and said first coaxial cable for selectively matching said impedance at said base end of said antenna to said impedance of said first coaxial cable in response to the FM broadcast signal;

said first and second impedance matching circuit means feeding respective AM and FM output signals thereof to the AM-FM radio receiver via said first coaxial cable;

said first impedance matching circuit means comprising:

a first bandpass filter for selectively passing only the AM broadcast signal therethrough; and a first impedance matching circuit connected to an output of the first bandpass filter for selectively matching said impedance at said base end of said antenna to said impedance of said first coaxial cable in response to the AM broadcast signal; and said second impedance matching circuit means comprising:

a second bandpass filter for selectively passing only the FM broadcast signal therethrough; and a second impedance matching circuit connected to an output of the second bandpass filter for selectively matching said impedance at said base end of said antenna to said impedance of said first coaxial cable in response to the FM broadcast signal.

2. An antenna device as in claim 1, wherein said first impedance matching circuit comprises a field effect transistor (FET) having a gate connected to said output of the first bandpass filter, the AM broadcast signal received by said antenna being fed to said gate of said FET, an output signal amplified by said FET being fed from a drain of said FET to said first coaxial cable.

3. An antenna device as claimed in claim 1, wherein said antenna comprises:

an antenna rod extending from said base end of said antenna;

a feed tube in which said antenna rod is slidably movable, said antenna rod being electrically connected to a leading end of said feed tube; and an adjusting feed tube electrically connected to said feed tube and slidably mounted at one end on a trailing end of said feed tube and formed at the other end with a feed point.

4. An antenna device as claimed in claim 3, wherein said antenna further comprises an electrically conductive, resilient feed spring which electrically connects said antenna rod to said feed tube and guides said antenna rod for sliding movement in said feed tube.

5. An antenna device as claimed in claim 1, in which said second impedance matching circuit means further comprises amplifier means for amplifying the FM broadcast signal.

6. An antenna as claimed in claim 1, further comprising a bandpass filter connected between said base end of said antenna and the second coaxial cable for selectively passing only the telephone signal therethrough.

* * * * *